US005996588A

United States Patent [19]

Abrines Amer

[11] Patent Number: 5,996,588

[45] Date of Patent: Dec. 7, 1999

[54] POCKET ASHTRAY EQUIPPED FOR HOLDING A PACKET OF TOBACCO AND PROTECTION FOR THE BASE OF THE LATTER, WITH A DEPOSIT FOR EXTINGUISHING CIGARETTE BUTTS

[76] Inventor: D. Gabriel Abrines Amer, Bartolome Canellas, 10, 07360 Lloseta (Baleares), Spain

[21] Appl. No.: 09/174,316

[22] Filed: Oct. 19, 1998

[51] Int. Cl.[6] ..... A24D 1/12; A24F 13/18; A24F 15/08

[52] U.S. Cl. ..... 131/231; 131/237; 131/241; 131/242; 131/175; 131/187; 131/235.1; 131/238; 131/240.1; 206/246; 206/248

[58] Field of Search ..... 131/231, 235.1, 131/237, 238, 240.1, 242, 175, 187, 241; 206/246, 248, 567

[56] References Cited

U.S. PATENT DOCUMENTS

| | | | |
|---|---|---|---|
| 3,018,878 | 1/1962 | Watkins | 206/246 |
| 3,029,931 | 4/1962 | Watkins | 206/246 |
| 5,682,986 | 11/1997 | Cobler | 206/265 |
| 5,799,781 | 9/1998 | Arthur | 206/246 |

*Primary Examiner*—James Derrington
*Assistant Examiner*—Dionne A. Walls
*Attorney, Agent, or Firm*—Dennison, Meserole, Scheiner & Schultz

[57] ABSTRACT

A pocket ashtray made of fireproof materials for holding a packet of cigarettes comprising a part for depositing ash and cigarette butts, a cigarette pack support part, an intermediate area including a tilting door for giving access to the depositing part and for closing against the deposit part so as to prevent air entry.

5 Claims, 3 Drawing Sheets

POCKET ASHTRAY EQUIPPED FOR HOLDING A PACKET OF TOBACCO AND PROTECTION FOR THE BASE OF THE LATTER, WITH A DEPOSIT FOR EXTINGUISHING CIGARETTE BUTTS

BACKGROUND OF THE INVENTION

The need to have an ashtray available at a given moment or a suitable place to deposit the ashes or butts, makes this a critical moment, a "space-time" problem that has to be resolved in a matter of seconds. This problem affects a large sector of the population "smokers", and has repercussions in the form of social and environmental problems for society as a whole. Seeing cigarette butts in the streets or in the most unexpected places, and forest fires (often attributed to a badly extinguished cigarette butt) have become a daily image. In a society that is increasingly demanding with itself in the endeavour to improve day by day in different aspects of life (coexistence, cleanliness, ecology, etc.), we must seek solutions and promote the means to carry them out, and always foster coexistence among people and an agreeable state of affairs.

There is a great diversity of ashtrays distributed more or less strategically in public and private places. These fulfill their function, but they are static and only effective in a limited spatial radius. If, at the critical moment of discarding the cigarette butt, a smoker finds himself outside this radius and does not wish to throw the butt on the ground, he is forced to improvise a solution, such as an empty can, a finished packet or other solutions devised for the purpose. But these solutions are circumstantial and do not ensure that the embers are well extinguished, and therefore their use may be dangerous because they lack the necessary conditions of safety and transport.

The present product fulfills the conditions mentioned hereinbefore and proposes, in being marketed and used, to be of help to smokers at the critical moment or to be of service in other aspects.

It will not be circumstantial, because it may be acquired at the same time as the packet of cigarettes and, owing to the fact that it is coupled with the packet, it may remain together with the latter until it is empty, being always available at the critical moment. This same fact allows it to occupy the same space as the packet, only lengthening as it is used; but it may be emptied at the most appropriate time and return to its previous state. Inside it, there is room for a whole packet and it may be used as a cigarette case. After being used, it may be thrown away or re-used.

OBJECT OF THE INVENTION

The object of the model, according to a preferred idea of the same, is an inexpensive receptacle which, ideally, is disposable.

The receptacle is an open rectangular parallelepipedal box for containing the packet, like a cigarette case, which has the essential specific functions described in the descriptive part of the present document and is provided with means to facilitate extraction of the packet.

Another idea of the model is that the said box-cigarette case should fulfill the functions of an ashtray, to which end the box has an intermediate area that is jointed laterally and, once the trapdoor is open, these joints form notches for fitting the cigarettes. This intermediate area serves as a separation between the packet and the deposit-collector for cigarette butts at the bottom.

An idea of the model is that, moreover, the trapdoor should close hermetically in such a way that between the packet and the bottom an inert vacuum (free of air) is created, which extinguishes and puts out the cigarette butt due to lack of oxygen.

It is also an idea of the model to insulate the bottom of the deposit-collector from the packet with fireproof material, specifically with an adherent sheet.

A more extensive idea of the model's essential characteristics is given below, where we refer to the sheet of drawings that accompanies this statement, in which, somewhat diagrammatically and only by way of example, the preferred details of the model are represented.

DETAILED DESCRIPTION OF THE INVENTION

With respect to its safety characteristics, its ergonomy combines with the fireproof materials of its interior. Extinguishing of the embers and watertightness are ensured when the cigarette butt (Y) is deposited inside deposit area (1), and the butts are pressed by the packet (P) and, before that, the tilting trapdoor (B) is pressed so that the latter closes and also, if they are being used, the hinges (D), prevent air from entering the inside of the deposit area. Pushing until the cigarette butts are compressed, the air exits and, when the remaining oxygen is consumed, the embers of the cigarette butts are completely extinguished in a few seconds.

The materials used in the inventions interior construction are malleable and fireproof, and are optional for the exterior. The outer surfaces may serve to carry advertising. It may be produced in packaging manufacturing industries and has an application in the tobacco sector.

As shown in FIGS. 1–4, the device is shaped as a rectangular box which has three areas, open in the upper part ($X^1$).

The lower part used as a deposit or collector area in which cigarette butts are extinguished by lack of oxygen and deposited for transport.

Intermediate support area used as an ashtray (3) and an upper part (2) in which a cigarette packet is introduced and where it is supported when in use. In its upper part two cuts or indentations (A) are shaped like semicircles, which allow the stored packet to be readily extracted.

The intermediate support area includes mobile parts. A trapdoor (B) which is opened by inward pressure to permit deposit of ashes to introduce the cigarette butts and, giving access to collector area.

The trapdoor (B) has a projecting part on its lower edge in the form of a flap (C) which closes hermetically against the lower part and prevents air from entering, creating an inner vacuum, devoid of oxygen, that extinguishes the burning cigarette butt.

The trapdoor (B) tilts upon lateral hinges (D), which when open form mounting notches (D'), wedge-shaped cuts that open inward and allow a lighted cigarette to be inserted.

Figure 1:
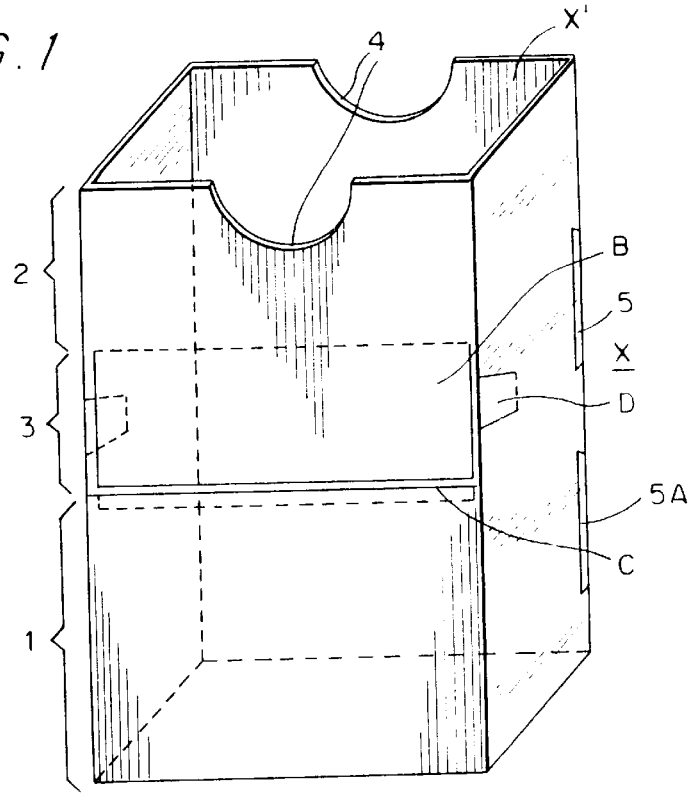
FIG. 1 is a perspective view of the assembled unit.
Figure 2:
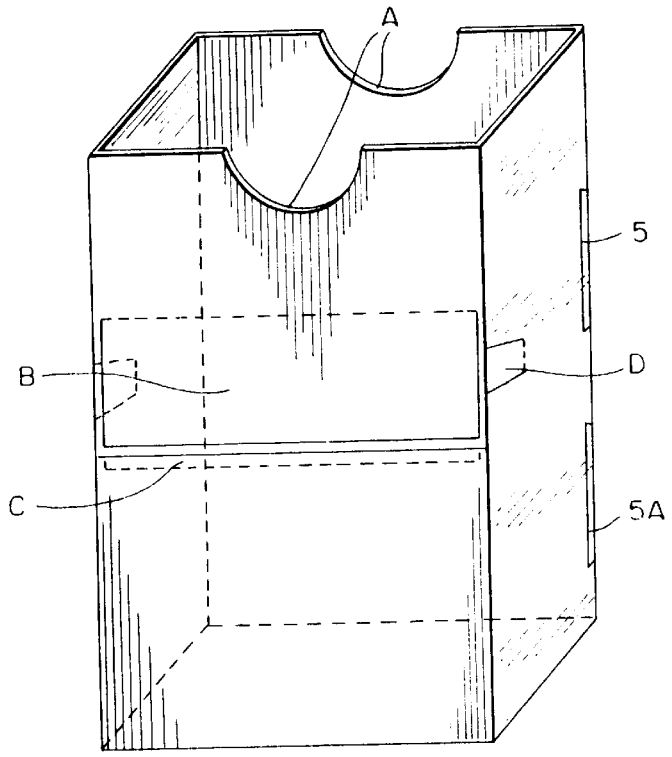
FIG. 2 is a similar view to the foregoing.
Figure 3:
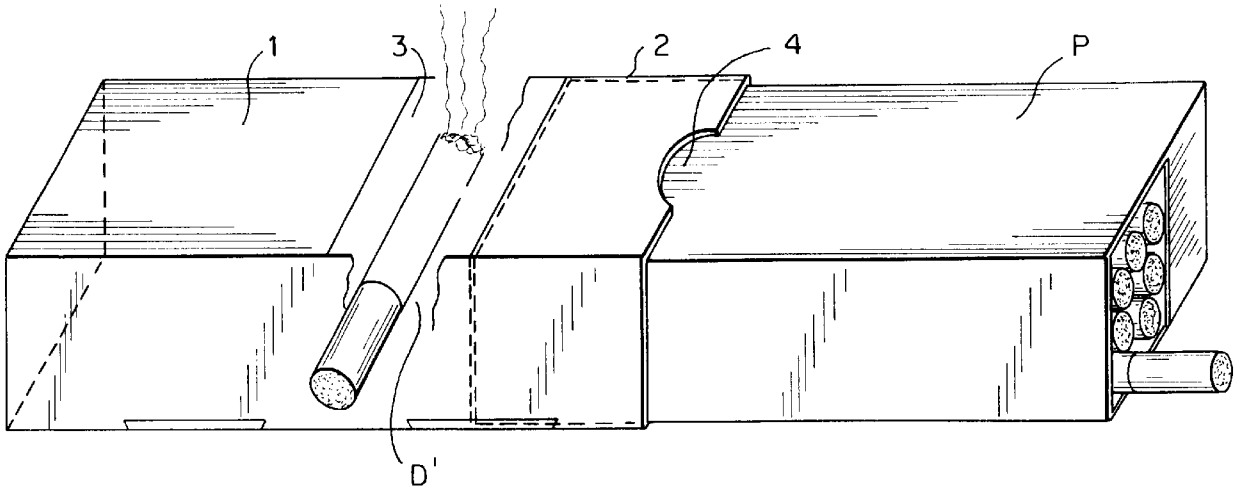
FIG. 3 is a perspective view of the unit in its open position, actively functioning as an ashtray.
Figure 4:
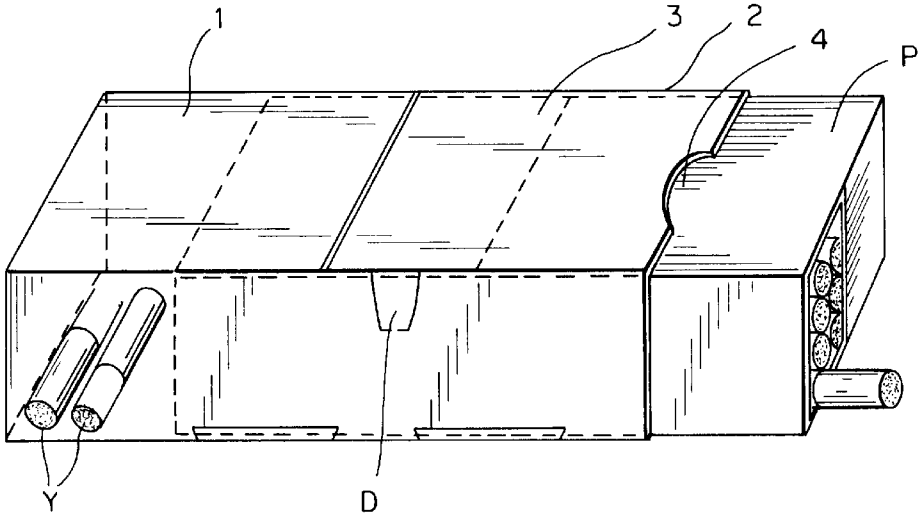
FIG. 4 is a perspective view of the unit in its closed position, passively functioning as an ashtray.
Figure 5:
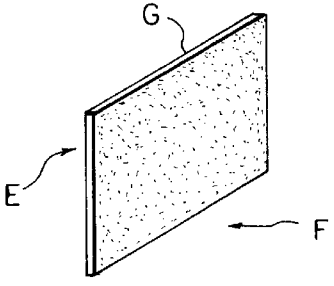
FIG. 5 is a perspective view of the fireproof protector of the packet.

The protection part (G) for the base of the packet (P) of tobacco (FIG. 5) is a rectangular sheet made of fireproof material on side (E) and adhesive material outside (F) in order to stick to the base of the packet. The protection part (P) the function of separating the packet from the embers of the cigarette butts (Y) present in the collector area.

Figure 6:
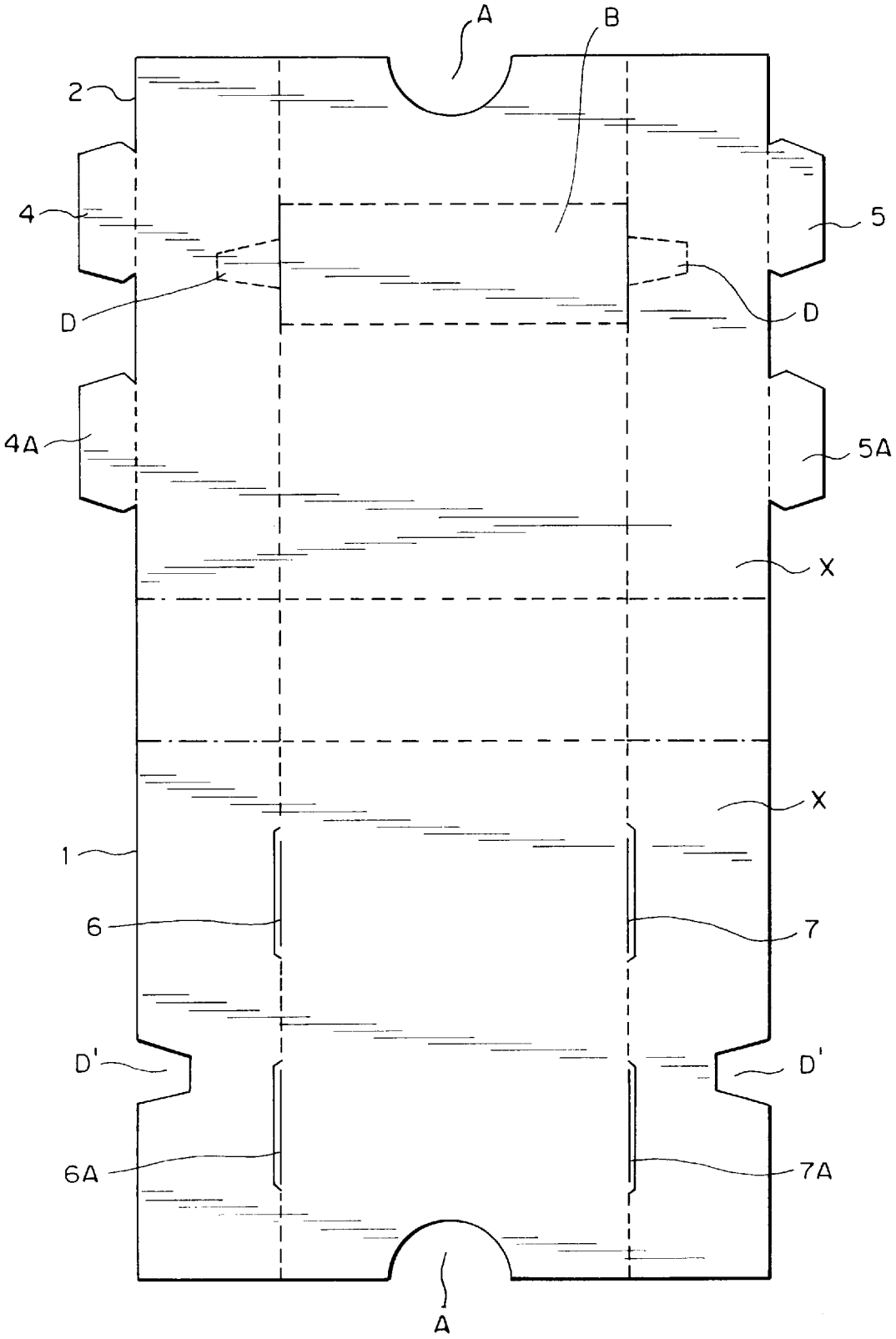
FIG. 6 is a developing view for the manufacture of the receptacle in accordance with a preferred embodiment of the model.

A preferred embodiment is conditioned by the cutting pattern (FIG. 6) and detailed instructions for assembly are given hereinbelow.

The cut of the part may be carried out by marking and cutting the pattern directly onto the sheet; another form of cutting would be by means of pressure machine stamping or by a shearing machine.—Cut along the continuous lines and fold inward along the discontinuous lines.—Join and stick or join and overlap the coinciding parts or the tongues and grooves.—The dots indicate the folding of the mobile parts.

For this purpose, on the outer edges of the sides of the upper area (2) there is a double set of tongues (4-4A) and (5-5A) respectively and, in the lower area (1), on the vertical intermediate fold line (represented as a dotted line), corresponding sets of grooves (6-6A) and (7-7A) which coincide with the respective overlaps (4-4A) and (5-5A) when the parts are folded along the corresponding transverse fold lines of the ashtray area.

For correct operation, the measurements and shapes may vary so that the different ashtrays may be coupled together, allowing combinations among themselves.

Having suitably described the nature of the invention, it is stated for the appropriate purposes that the same is not restricted to the exact details of this description, but rather, on the contrary, any modifications considered appropriate may be introduced into it, provided that the essential characteristics of the same are not altered, which are claimed hereinbelow.

I claim:

1. A pocket ashtray made of fireproof materials equipped for holding a packet of cigarettes with protection for the packet base from a deposit area for extinguishing cigarette butts and being made up of a parallelepipedal and rectangular box that is open in its upper part comprising:

a deposit area (1) situated in a lower part where cigarette butts are extinguished through lack of oxygen and deposited for transport;

a support area (2) in an upper part into which a packet of cigarettes can be introduced and contained when a tilting trap door (B) and wedge-shaped cuts (D) are in use; wherein the support area (2) has two semi-circular indentations (A) which allow a packet of cigarettes to be readily extracted;

an intermediate area (3) of mobile parts which consists of the tilting trap door (B) that opens by pressing inward giving access to the deposit area to deposit ashes or to introduce cigarette butts, the trap door including a projecting part (C) on its lower edge that closes hermetically against the deposit area preventing air from entering; wherein the area of mobile parts (3) tilts laterally on hinges made up of wedge-shaped cuts (D) that, when open, form notches (D') that allow a cigarette to be lodged in the notches; and a protection part (G) for the base of the packet of cigarettes comprising a rectangular sheet made of fireproof material (E) on one side and adhesive material (F) on the other side for adhering to the base of the packet of cigarettes, said protection part acting as insulation between said base and the contents of the deposit area.

2. The pocket ashtray according to claim 1, wherein the inner surfaces of the rectangular box exposed to the temperature of the ashes are lined with fireproof material.

3. The pocket ashtray according to claim 2, wherein the outer surfaces of the rectangular box are made of fireproof material.

4. The pocket ashtray according to claim 2, wherein at least one outer surface of the box is used to carry advertising material.

5. The pocket ashtray according to claim 1, wherein the rectangular box is formed from a sheet plate with fold lines which, when folded, may be joined at coinciding parts, so that for joining the outer edges of the sides of the upper part, there is formed a double set of trapezoidal tongues (4-4A) and (5-5A) respectively, and in the lower body (1) on vertical intermediate fold lines, there are corresponding sets of grooves (6-6A) and (7-7A) into which the tongues (4-4A) and (5-5A) can be fitted.

* * * * *